United States Patent [19]

Grössler et al.

[11] Patent Number: 4,638,130

[45] Date of Patent: Jan. 20, 1987

[54] ACCELERATION SENSOR

[75] Inventors: Peter Grössler, Hochstadt; Norbert Nissl, Aresing, both of Fed. Rep. of Germany

[73] Assignee: Messerschmitt-Boelkow-Blohm Gesellschaft mit beschraenkter Haftung, Munich, Fed. Rep. of Germany

[21] Appl. No.: 662,089

[22] Filed: Oct. 18, 1984

[30] Foreign Application Priority Data

Oct. 26, 1983 [DE] Fed. Rep. of Germany ..... 3338784

[51] Int. Cl.[4] ..... H01H 35/14

[52] U.S. Cl. ..... 200/61.45 R; 200/61.5; 200/61.53; 307/121

[58] Field of Search ..... 307/121; 200/61.45–61.53, 61.08

[56] References Cited

U.S. PATENT DOCUMENTS

| | | | |
|---|---|---|---|
| 2,972,134 | 2/1961 | McKay | 200/61.08 |
| 3,489,917 | 1/1970 | Gurol | 307/121 |
| 3,735,072 | 5/1973 | Six, Jr. | 200/61.5 |
| 3,745,277 | 7/1973 | Shawcross et al. | 200/61.5 |
| 3,794,794 | 2/1974 | Provancher | 200/61.08 X |
| 4,178,492 | 12/1979 | Roesch et al. | 200/61.5 |
| 4,191,868 | 3/1980 | Sunde | 200/61.5 |
| 4,490,707 | 12/1984 | O'Leary | 200/61.08 X |

*Primary Examiner*—L. R. Scott

*Attorney, Agent, or Firm*—W. G. Fasse; D. H. Kane, Jr.

[57] ABSTRACT

An acceleration sensor comprises a housing formed with a hollow cavity defining a sensing direction. An acceleration sensing conductive mass is releasably mounted in the cavity. The mass is released by a cutting member which severs the releasable mounting of the acceleration sensing mass. A force applying assembly is activated to cause movement of the cutting member. Switch electrodes are arranged at the lower end of the housing cavity. The mass falls through a predetermined distance and bridges the switch electrodes. The sensing mass, when severed, may move in incremental steps due to the use of a two-stage releasing assembly. Sensing transducers may be located along the falling path of the acceleration sensing conductive mass.

5 Claims, 6 Drawing Figures

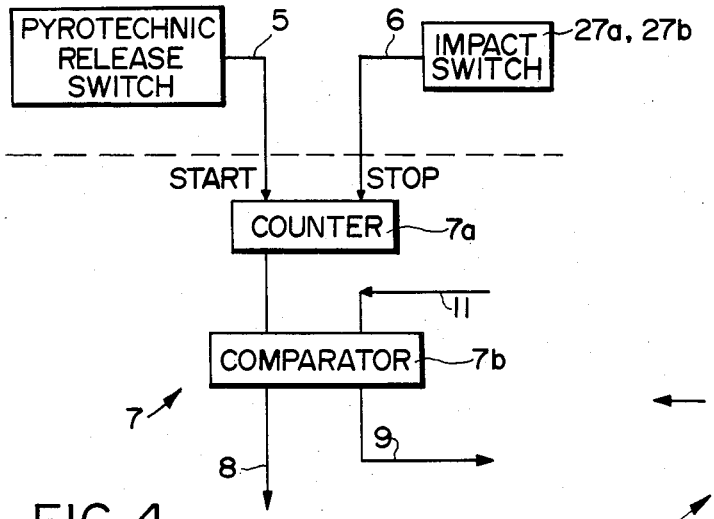
FIG. 4
FIG. 3
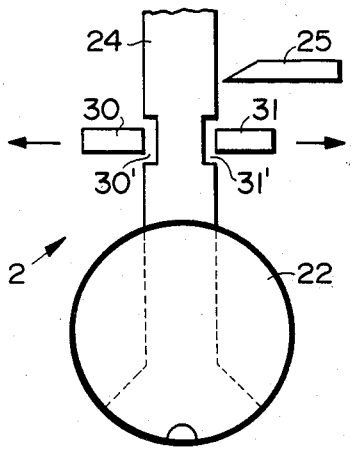
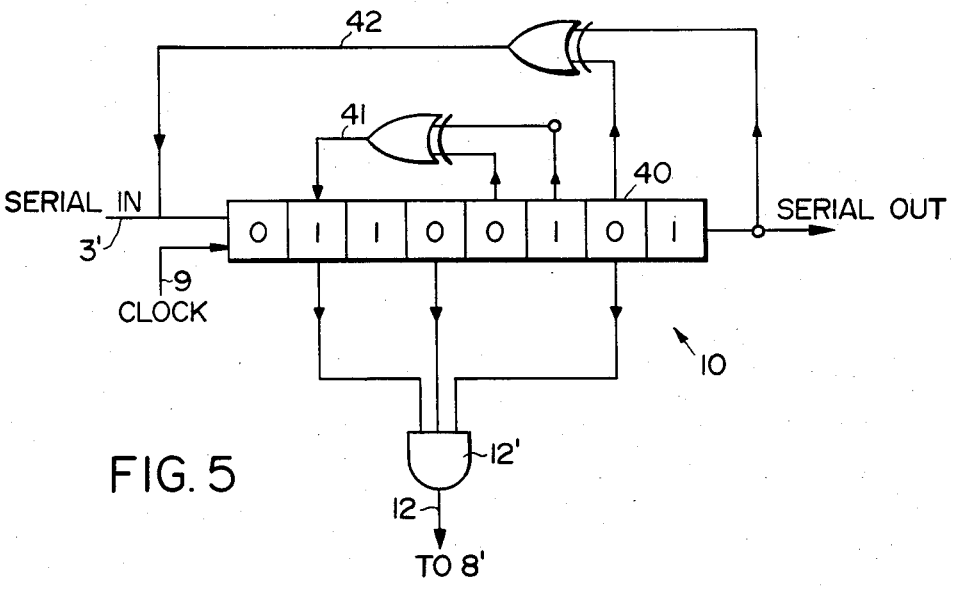
FIG. 5

ACCELERATION SENSOR

FIELD OF THE INVENTION

The invention relates to a method and apparatus or system for detecting different detonating conditions for a follow-up charge in a dual stage weapon containing a primary explosive charge and the follow-up explosive charge. Sensors, especially acceleration sensors are used to provide signals to be evaluated for determining the respective detonating condition.

DESCRIPTION OF THE PRIOR ART

A dual stage weapon comprises a primary explosive charge for enabling the weapon to penetrate a target surface and a follow-up explosive charge intended to explode under certain conditions prevailing at or in the target. Sensors, especially acceleration sensors, are used for determining the environmental conditions at or in the target after the primary explosive charge, for example a hollow explosive charge, in a dual stage or tandem weapon has already exploded. These weapons may include bombs to be dropped, shells or rockets or the like which are constructed to first penetrate a target surface such as an airport runway, or the wall of a target such as a tank, a submarine, a fortification or the like. The follow-up explosive charge is then supposed to detonate inside the target or underneath the runway surface.

Especially in connection with bombs constructed for destroying runways and highway surfaces, it is important for a maximum destructive effect that the primary explosive charge enables the bomb to penetrate through the surface and that the follow-up explosive charge is detonated in response to certain detonating conditions. Thus, it is important, for example, to determine whether the follow-up explosive charge has remained stuck in the target wall or whether it has rebounded from the target surface. These conditions are determined with the aid of sensors, the output signals of which are suitably combined to produce a detonating signal for the follow-up explosive charge. Rebounding or getting stuck by the weapon may depend on the dynamic conditions to which the weapon is exposed once it has contacted the target. Gas dynamic conditions may be involved as well as dynamic conditions caused by the respective environment such as the runway or the like. For example, when the local dynamic conditions cause the weapon to rebound, the follow-up explosive charge shall be detonated instantly. On the other hand, when the bomb gets stuck in the runway the follow-up explosive charge shall be placed or switched into a lurking state which will only be terminated when the weapon in its lurking stage is approached or driven over at which time it is to explode.

In the just described environment it has been a problem heretofore to provide the sensors capable of meeting the requirements. Such sensors must be compatible with a very rapid and highly precise signal processing to make sure that the proper time is detected when the weapon, for example, begins to rebound. The accelerations occurring under these conditions are very large and prior art acceleration sensors are not only very expensive, they are also not precise enough in responding to these very large accelerations.

Prior art acceleration sensors are either constructed for measuring a high acceleration, in which case they do not have a very large measuring sensitivity or rather precision. On the other hand, acceleration sensors having the required measuring precision or sensitivity are capable of sensing only relatively small accelerations. If such highly sensitive prior art acceleration sensors for measuring small accelerations are temporarily exposed to higher accelerations or even shock type accelerations, these prior art sensors are either temporarily or permanently incapacitated.

OBJECTS OF THE INVENTION

In view of the foregoing, it is the aim of the invention to achieve the following objects singly or in combination:

to provide a method and system which is capable of determining the proper detonating condition for a follow-up charge in a tandem or dual stage weapon depending on the instantaneously prevailing operating situation of the weapon;

to provide an acceleration sensor which is simple in its structure and inexpensive to manufacture, yet capable of detecting the proper detonating condition out of several possible detonating conditions, whereby the sensor shall precisely differentiate between a rebounding situation and the situation where the weapon got stuck in a surface, the sensor shall be precise, that is sensitive, over a wide acceleration range; and the present system shall also be able to recognize an approach to the weapon, for example, by personnel intending to remove the weapon or by a vehicle or aircraft driving over the weapon which got stuck.

SUMMARY OF THE INVENTION

The present method and system detects the detonating conditions for a follow-up charge in a tandem or dual stage weapon with the aid of acceleration sensors which provide output signals to a logic circuit connected to the detonator of the follow-up charge. According to the system and method of the invention a first acceleration sensor, having a low sensitivity and which is not locked when the dual stage weapon is fired, dropped, or launched, releases with its output signal, after an adjustable time delay, a locking member of a second initially locked acceleration sensor having a high sensitivity. Then the output signal of the second now unlocked acceleration sensor is used as a time reference or time criterion for determining the type of activation of the follow-up charge. The output signal of the second highly sensitive acceleration sensor may be evaluated together with the output signals of one or more additional acceleration sensors which may provide its signal or their signals through a random function generator.

The above mentioned second acceleration sensor according to the invention has a high sensitivity over a wide range of accelerations and comprises housing means forming a cavity having a central axis defining a sensing direction, acceleration sensing mass means, mounting means releasably mounting said sensing mass means in said cavity of said housing means, releasing means operatively arranged for cooperation with said mounting means for releasing said sensing mass means for movement in said cavity of said housing means in said sensing direction upon release of said sensing mass means, and switch means operatively aranged in said housing means in a position for actuation of said switch means by said sensing mass means after said sensing mass means has moved through a predetermined distance in said sensing direction in said cavity.

BRIEF DESCRIPTION OF THE DRAWINGS

In order that the invention may be clearly understood, it will now be described, by way of example, with reference to the accompanying drawings, wherein:

FIG. 3 shows the sensing mass of the acceleration sensor of FIG. 2 with a sequential two stage release of the acceleration mass following the dropping, firing, or launching of a weapon equipped with such a sensor;

FIG. 4 is a block diagram of a discriminator or detector suitable for use in the circuit of FIG. 1;

FIG. 5 is a circuit diagram for a random function generator for use in the circuit of FIG. 1.

DETAILED DESCRIPTION OF PREFERRED EXAMPLE EMBODIMENTS AND OF THE BEST MODE OF THE INVENTION

Figure 1:
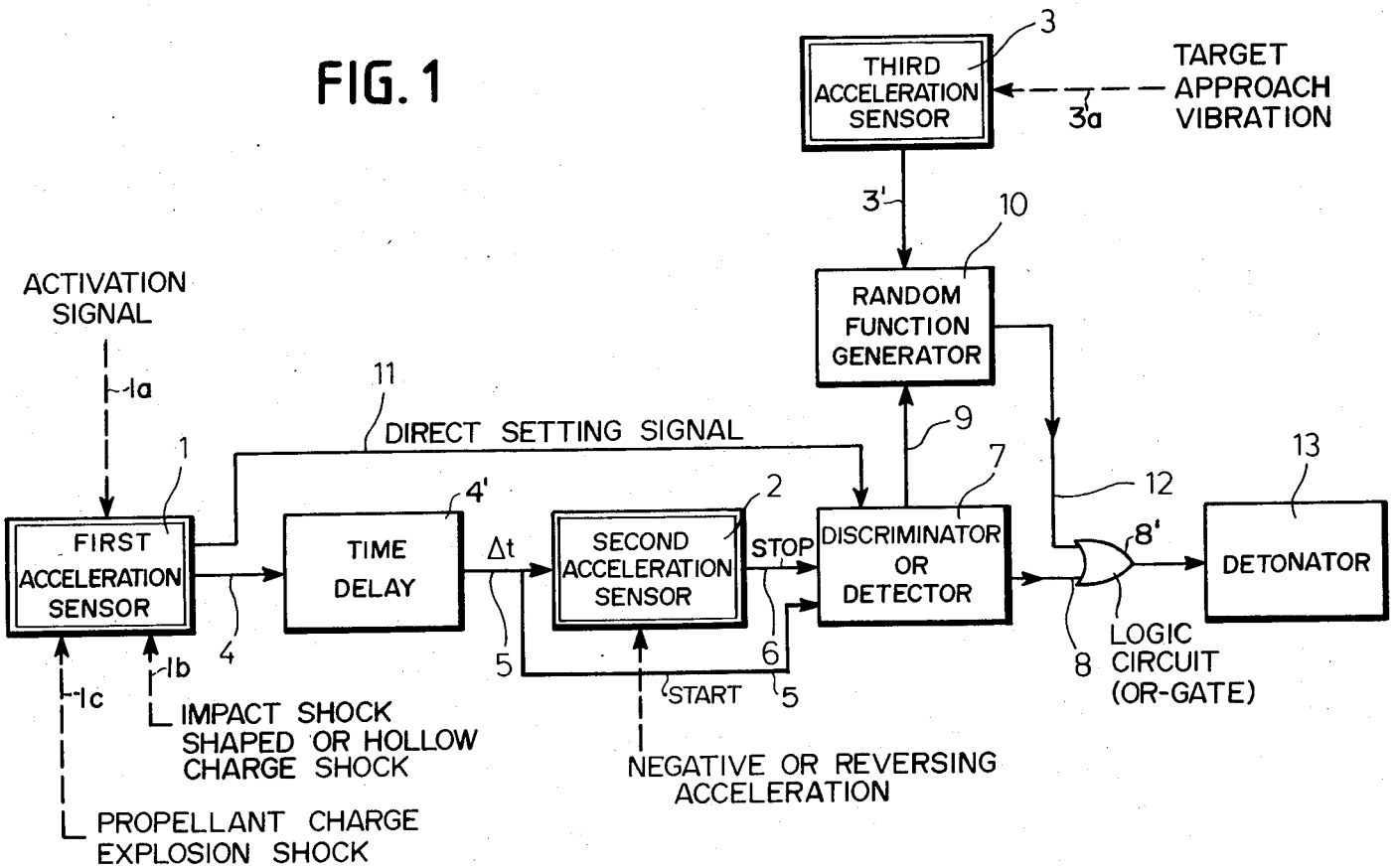
FIG. 1 is a block circuit diagram of the present system for detecting different detonating conditions for a follow-up charge in a dual stage weapon.

The block circuit diagram of FIG. 1 illustrates a system for detecting different detonating conditions for a follow-up charge by performing the method disclosed herein. A dual stage weapon for example, a bomb of which only the detonator 13 is shown in FIG. 1, is activated or "made live" by conventional means on board of the delivery device such as an aircraft Such activating involves providing an electrical current impulse to the weapon which also activates the power supply or the follow-up charge. Auxiliary capacitors in the power supply of the follow-up charge and the power supply of the follow-up charge are activated by charging these capacitors and by activating, for example by pyrotechnical means, a thermal battery forming conventionally part of the power supply of the follow-up charge.

The present system comprises a first acceleration sensor device 1 for example, in the form of a conventional piezo-electric sensor with its respective electrical circuit. The first acceleration sensor 1 receives the above mentioned activation signal just prior to or at the time of releasing a bomb, as indicated by the arrow 1*a*. The first acceleration sensor 1 senses an impact shock when the weapon hits the target and it also senses the explosion of a hollow or so-called shaped charge forming the primary explosive charge of the weapon. This is indicated by an input arrow 1*b*. A further input arrow 1*c* represents an input to the first acceleration sensor 1 which is provided, for example, when the weapon is a rocket and its propellant charge explodes. The first acceleration sensor 1 has only a relatively low acceleration sensitivity and is constructed without any locking means so that its response is available immediately upon activation of the weapon.

The first acceleration sensor 1 produces a first output signal 4 which is supplied through a time delay device 4' such as an RC network to provide a delayed first output signal 5 which is available after a time delay Δt after the occurrence of the output signal 4. The delayed first output signal 5 is supplied to a second acceleration sensor 2 for activating the latter for example, by exploding a charge 26 as will be described in more detail below with reference to FIG. 2 which also shows the details of the second acceleration sensor 2.

Referring further to FIG. 1, the second acceleration sensor 2 is constructed to sense a negative or reversing acceleration when the weapon should rebound, whereby the acceleration sensor 2 produces an output signal 6 which is supplied through the conductor 6' (FIG. 2) to a discriminator or detector circuit 7. If there is no rebounding, the first acceleration sensor 1 also provides a second output signal 11 which is supplied as a direct setting signal to a further input of the discriminator or detector circuit 7.

The size or any other criterion of the output signal 6 is used for determining or detecting the applicable release or triggering condition for the detonator 13. If there is a rebounding signal provided by the second acceleration sensor 2, the discriminator provides an instantaneous output signal 8 which is supplied through a logic OR-gate 8' to the detonator 13 of the weapon which is thus instantly detonated when a rebounding occurs.

On the other hand, if no rebounding occurs, the detector 7 determines that the weapon is to be placed into a "lurking" state for detonation at a random later time or in response to a further acceleration or vibration signal 3' provided by a third acceleration sensor 3. The arrow 3*a* into the sensor 3 signifies that this sensor picks up target approach vibrations, for example, when a vehicle or aircraft rolls over the weapon or when personnel approaches the weapon for removal.

The random function generator 10 is provided to make a removal of the weapon more difficult. For this purpose the random function generator 10 receives at one of its inputs the signal 3' from the third acceleration sensor 3 and at another input the generator 10 receives the signal 9 from the discriminator or detector 7 signifying a lurking condition as mentioned above. The random function generator 10 provides a random function activating signal 12 which is also supplied through the OR-gate 8' to the detonator 13. Additionally, the random function generator 10 may be constructed to provide the random activating signal 12 independently of any input from the third acceleration sensor 3 and thus independently of any approach vibrations. Thus, the random function generator 10 may also operate as a random time delay for the detonating of the weapon when a lurking condition has been determined or detected.

Incidentally, the third acceleration sensor 3 shown in FIG. 1 may also be embodied by a piezo-electric vibration sensor of conventional construction. Therefore, a more detailed disclosure of the third acceleration sensor 3 is not provided.

Figure 2:
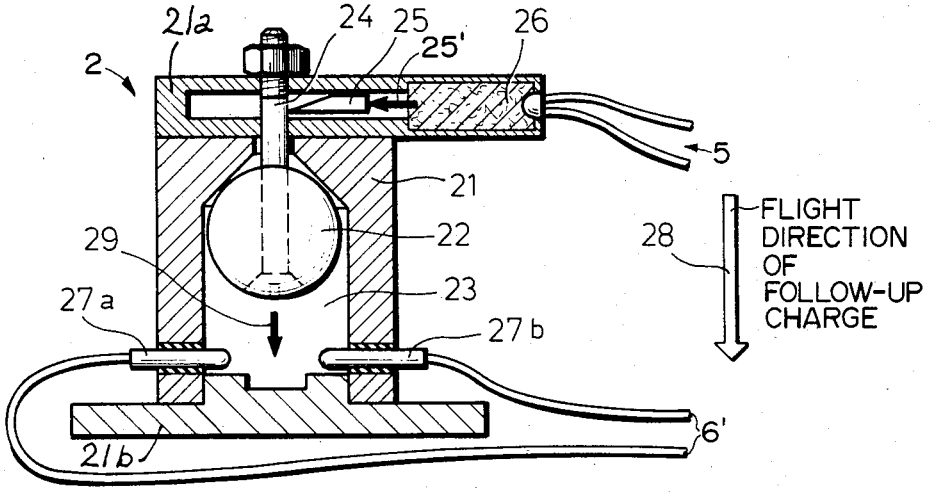
FIG. 2 is a sectional view through an acceleration sensor according to the invention having a high sensitivity of a wide range of accelerations, and suitable for use as the so-called second acceleration sensor as disclosed herein.

FIG. 2 shows an embodiment suitable for use as the second acceleration sensor 2 in FIG. 1. The acceleration sensor 2 comprises a housing 21 having a top cover 21*a* and a bottom cover 21*b* for enclosing a cavity 23 having a central axis defining a sensing direction as indicated by the arrow 29. An acceleration sensing mass 22 is releasably mounted inside the cavity 23 by a releasable mounting member such as a screw 24 which may be released by a releasing device including a cutter 25 which severs the screw 24 in response to a force 25' generated when the explosive charge 26 is ignited by a signal 5 from the time delay device 4'. When the mass 22 is free to move in the cavity 23 in the direction of the arrow 29 due to the severing of the screw 24, the movement of the mass 22 is dependent on the acceleration to which the follow-up charge is exposed, such as a rebounding acceleration. In response to such rebounding acceleration the ball 22, after a certain travel or falling time in the cavity 23, will close the contacts 27*a*, 27*b* to provide the second output signal 6 to be supplied to the discriminator 7 through the conductors 6'. The duration of the time needed by the ball 22 for traversing the distance in the cavity 23 until it closes the circuit through the contacts 27*a*, 27*b* is evaluated by the discriminator as a detonating condition for the detonator 13.

Figure 6:
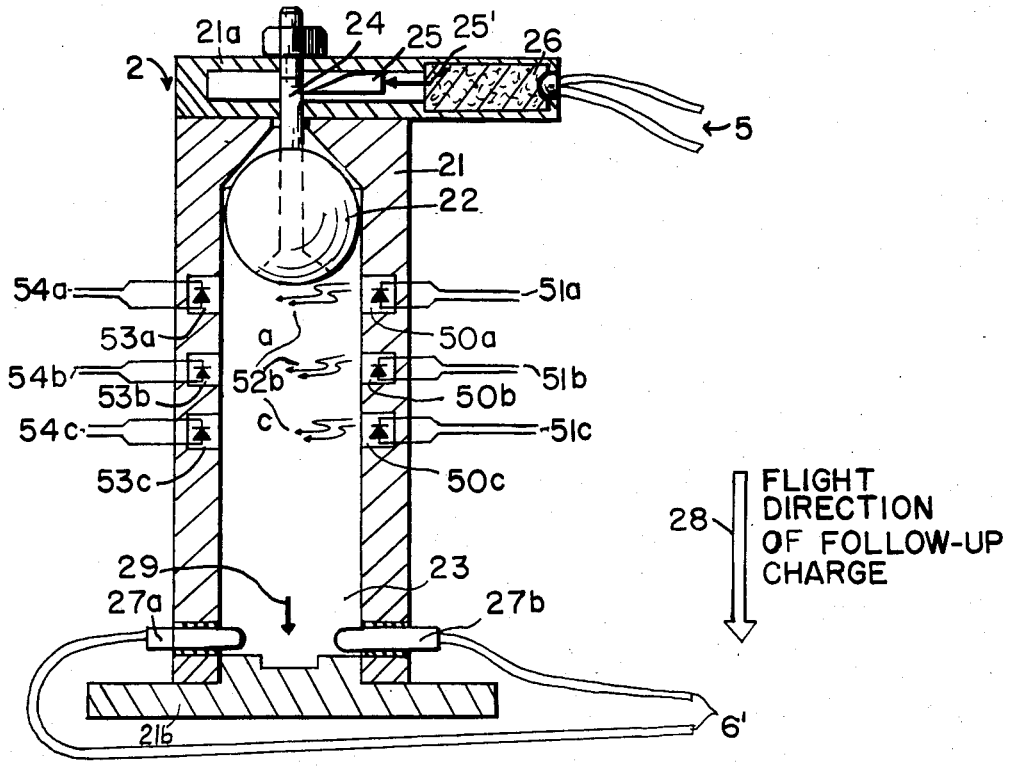
FIG. 6 is a view as in FIG. 2, but showing additional sensors in the housing.

The sensitivity of the sensor 2 as shown is quite satisfactory for most practical purposes. However, it is possible to further increase the sensitivity of the sensor 2 by providing optical or inductive sensing members in the housing 21 along the cavity 23 for sensing of the acceleration dependent movement of the mass 22. An example of optical sensing members 53*a*, 53*b*, 53*c* is shown in FIG. 6. Light emitting sources 50*a*, 50*b*, 50*c*, such as LEDs, energized through leads 51*a*, 51*b*, 51*c* produce light beams 52*a*, 52*b*, 52*c* which are interrupted by the ball 22 falling through the housing 21. The light interruption is sensed by the sensing members 53*a*, 53*b*, 53*c*. The respective signals pass through leads 54*a*, 54*b*, 54*c* to conventional evaluation circuits not shown. A still further improvement in the sensitivity or measuring accuracy of the sensor 2 may be achieved by dividing the mass 22 into two or more partial masses which may be released independently of each other.

The main advantage achieved by the invention is seen in that the present method and system may be realized by simple and hence inexpensive components while simultaneously assuring a precise sensing or ascertaining of a reversing point in the flight direction 28 of a dual stage weapon including a follow-up charge for determining the applicable detonating condition.

FIG. 3 shows a modification of the sensor 2 which has a two stage release. The first release stage is realized by the cutter 25 operated as described above. The second release stage is realized by locking bars 30 and 31 which are moved out of respective locking grooves 30' and 31' as indicated by the respective arrows, for example, in response to the operation of a solenoid not shown, but energized by a signal provided with a predetermined delay after the signal 5 has been applied for igniting the charge 26. Incidentally, the portion of the screw 24 remaining attached to the ball 22 after severing, forms a portion of the mass which participates in the sensing of the rebound acceleration.

FIG. 4 shows an example for the discriminator or detector 7 of FIG. 1. An impulse counter 7*a* is started, for example, by a signal 5 from the output of the delay circuit 4' which also triggers the release of the mass 22 in FIG. 2. Thus, such mass release and the starting of the counter 7*a* shall take place coincidentally. The counter 7*a* is stopped by the signal 6 provided when the mass 22 closes the contacts 27*a*, 27*b*. The output of the counter 7*a* is connected to a comparator 7*b* which provides the output signal 8 to the OR-gate 8' when the number of pulses counted until the stop signal is received remains below a value stored in the comparator 7*b*. In that case the detonator 13 is triggered substantially instantaneously. On the other hand, if the number of pulses counted between start and stop exceeds a predetermined value stored in the comparator 7*b*, an output signal 9 is supplied as the clock signal to an input of the random function generator 10 shown in FIG. 5. Incidentally, the signal 5 for starting the counter 7*a* may also be derived from the severing of the screw bolt 24 as a result of the pyrotechnical release of the screw bolt. This feature would avoid any delay between the ignition of the charge 26 and the actual severing.

The counter 7*a* may, for example, be operated with a pulse frequency of 5 kHz. Thus, if the counter then counts 100 pulses between start and stop, the time duration for the mass 22 to reach the contacts 27*a*, 27*b* would be 20 msec, for example.

The random function generator 10 shown in FIG. 5 is of conventional construction and comprises, for example, a shift register 40 provided with multiple feedback circuits 41, 42 including exclusive OR-gates as shown. One input of the shift register 40 receives the signal 9 from the respective output of the detector 7 or comparator 7*b*. The other input receives the third acceleration signal 3' from the sensor 3. The shift register 40 varies the stored binary value in a pseudo-random manner after each input of the signal 9. Outputs of the shift register 40 are connected to the input of an AND-gate 12' which provides at its output the signal 12 to the OR-gate 8'. The arrangement of the logic circuit means may be such that the output signal 12 is provided in response to a value recognition on an average for each fifth "word" resulting in a coincidence at the AND-gate 12'. With regard to the signal 3' the shift register 40 provides an able/disable condition for passing on the signal 3' of the third acceleration sensor 3 to function as a trigger signal for the detonator 13.

Although the invention has been described with reference to specific example embodiments, it will be appreciated, that it is intended to cover all modification and equivalents within the scope of the appended claims.

What is claimed is:

1. An acceleration sensor having a high sensitivity in a wide range of accelerations, comprising housing means (21) forming a cavity having a central axis defining a sensing direction, acceleration sensing mass means (22), mounting means (24) releasably mounting said sensing mass means in said cavity of said housing means, releasing means including a cutting member operatively arranged for severing said mounting means for releasing said sensing mass means for movement in said cavity of said housing means in said sensing direction upon release of said sensing mass means, force applying means arranged for applying a cutting force to said cutting member, and switch means operatively arranged in said housing means in a position for actuation of said switch means by said sensing mass means after said sensing mass means has moved through a predetermined distance in said sensing direction in said cavity.

2. The acceleration sensor of claim 1, further comprising pick-up means operatively arranged in said housing means for detecting the movement of said sensing mass means in said cavity of said housing means.

3. The acceleration sensor of claim 1, wherein said force applying means comprise an explosive charge for driving said cutting member through said mounting means.

4. The acceleration sensor of claim 1, comprising further releasing means operatively arranged for cooperation with said mounting means for releasing said sensing mass means after said first mentioned releasing means have already released said sensing mass means, whereby said sensing mass means moves in steps through said predetermined distance.

5. The acceleration sensor of claim 1, wherein said mounting means at least partially form part of said sensing mass means, whereby said sensing mass means comprises two partial mass components which are connected to each other.

* * * * *